US006481869B1

(12) United States Patent
Horandel et al.

(10) Patent No.: US 6,481,869 B1
(45) Date of Patent: Nov. 19, 2002

(54) PORTABLE ELECTRIC TORCH WITH DOUBLE LIGHTING AND FOCUSSING ADJUSTMENT

(75) Inventors: Ulrich Horandel, Halle (DE); Paul Petzl, Barraux; Alain Maurice, Meylan, both of (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 09/646,570

(22) PCT Filed: Mar. 3, 2000

(86) PCT No.: PCT/FR00/00542

§ 371 (c)(1),
(2), (4) Date: Sep. 19, 2000

(87) PCT Pub. No.: WO00/52384

PCT Pub. Date: Sep. 8, 2000

(30) Foreign Application Priority Data

Mar. 3, 1999 (DE) ..... 199 09 220

(51) Int. Cl.[7] ..... F21V 23/06; F21V 23/04
(52) U.S. Cl. ..... 362/251; 362/205; 200/60
(58) Field of Search ..... 362/251, 184, 362/187, 197, 202, 188, 247, 277, 205, 203, 207; 429/97; 200/60

(56) References Cited

U.S. PATENT DOCUMENTS

| | | | | |
|---|---|---|---|---|
| 1,832,443 A | * | 11/1930 | Barany | 362/184 |
| 4,214,295 A | * | 7/1980 | Morton | |
| 4,782,432 A | | 11/1988 | Coffman | 362/184 |
| 5,629,105 A | * | 5/1997 | Matthews | 362/184 |
| 5,871,272 A | * | 2/1999 | Sharrah et al. | 362/184 |

FOREIGN PATENT DOCUMENTS

| | | |
|---|---|---|
| FR | 2 708 714 | 2/1995 |

* cited by examiner

*Primary Examiner*—Sandra O'Shea
*Assistant Examiner*—Bao Truong
(74) *Attorney, Agent, or Firm*—Oliff & Berridge, PLC

(57) ABSTRACT

A portable electric torch with a double lighting includes a housing containing a first bulb associated to a first reflector, an actuating ring movable in rotation to perform both control of the lighting circuit of the bulb and adjustment of the focusing sing by relative movement of the bulb and reflector in translation. The lighting circuit includes a first disconnecting gap designed to be open or closed for switching the first bulb off and on, and in addition a second disconnecting gap for power supply of a second bulb when the actuating ring is in a preset angular position.

12 Claims, 18 Drawing Sheets

PORTABLE ELECTRIC TORCH WITH DOUBLE LIGHTING AND FOCUSSING ADJUSTMENT

BACKGROUND OF THE INVENTION

The invention relates to a portable electric torch having a housing containing:

- a first bulb associated to a first reflector for emission of a light beam,
- an actuating ring movable in rotation to perform both control of the lighting circuit of the bulb and adjustment of the focussing by relative movement of the bulb and reflector in translation respectively to a first and second angular position of said ring,
- and a first disconnecting gap designed to be open or closed, for switching the first bulb respectively off and on.

STATE OF THE TECHNIQUE

The document FR-A-2,513,740 describes a torch with a single bulb having a sub-assembly constituted by an actuating ring and a reflector, which is animated with a combined rotation and translation movement to command the switch controlling lighting and extinguishing of the bulb, and to control the adjustment of the focussing of the light beam emitted by the bulb.

The document FR-A-2,708,714 refers to a torch with a double light source using two bulbs inserted in an electrical circuit which is equipped with two switches controlled by a rotary switching strip. Adjustment of the focussing of the beam emitted by one of the bulbs is performed by means of a special knob distinct from the control means of the strip.

OBJECT OF THE INVENTION

The object of the invention is to achieve a portable electric torch providing double lighting and adjustment of the focussing by a simple and fast control operation.

The torch, according to the invention, is characterized in that the lighting circuit comprises, in addition, a second disconnecting gap for the power supply of a second bulb when said actuating ring is in a preset third angular position.

According to one feature of the invention, the first disconnecting gap is switched to the closed state before closing of the second disconnecting gap takes place to achieve sequential lighting of the first bulb followed by that of the second bulb. It can also be switched to the closed state after closing of the second disconnecting gap takes place to achieve the reverse sequential lighting cycle of the second bulb followed by that of the first bulb.

The first bulb is preferably an incandescent or halogen bulb for lighting at a distance and the second bulb is formed by a LED for close-up lighting, the two bulbs being connected in parallel.

The second bulb can be securedly united to the first reflector fixed onto the ring and is eccentric with respect to the first bulb.

The second bulb can also be mounted fixed on a lug of the housing and facing a circular groove arranged in the first reflector, the sector of said groove corresponding to the angular travel of the rotary ring.

According to another alternative embodiment, the second bulb is located outside the first reflector and is housed in an orifice of the housing.

The first reflector can be provided with a sleeve movable in translation and in rotation with the ring, the sleeve causing switching of the two disconnecting gaps, whereas the first bulb is accommodated in a fixed socket.

The first reflector is securedly united to the rotary ring, which can be blocked in translation when its internal threading cooperates with the conjugate threading of a cylindrical end-piece of an intermediate wall. The support socket accommodating the base-part of the first bulb is supported by said intermediate wall movable in translation to perform switching of the two disconnecting gaps and adjustment of the focussing.

BRIEF DESCRIPTION OF THE DRAWINGS

Other advantages and features will become more clearly apparent from the following description of an embodiment of the invention, given as a non-restrictive example only and represented in the accompanying drawings in which:

FIGS. 3A, 3B, 3C show an alternative embodiment of the torch according to the invention, respectively in the rest position, the lighting position of the second bulb, and the lighting position of the first bulb and FIGS. 3B, 4B and 5B show schematic cross-sectional views along the lines 3B—3B, 4B—4B and 5B—5B of FIGS. 3A, 4A and 5A, respectively;

DESCRIPTION OF VARIOUS PREFERRED EMBODIMENTS

Figure 1:
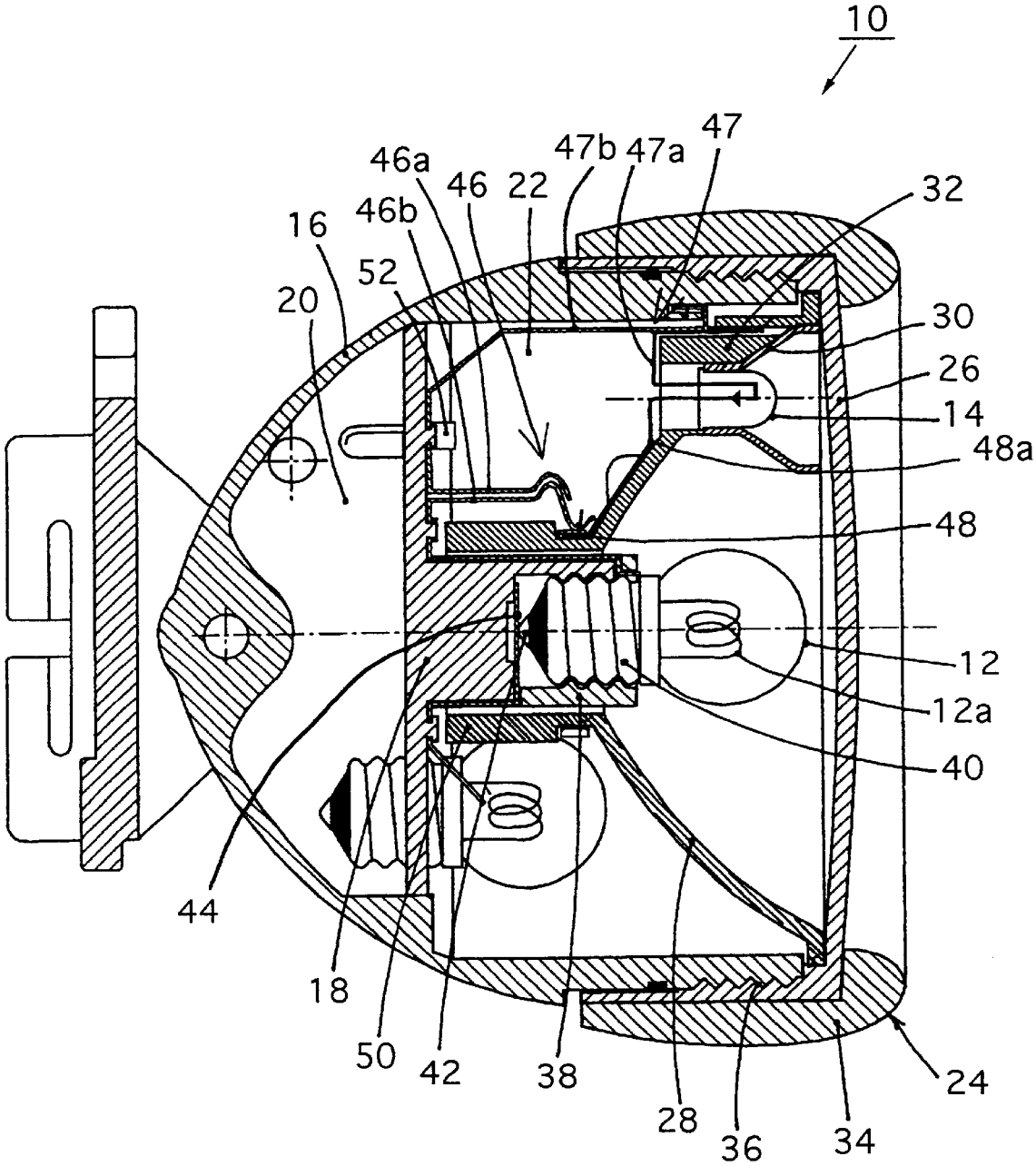
FIGS. 1 and 2 are cross-sectional views of a torch according to the invention, represented respectively in the lighting position of one or the other of the bulbs according to the position of the rotary ring.
Figure 2:
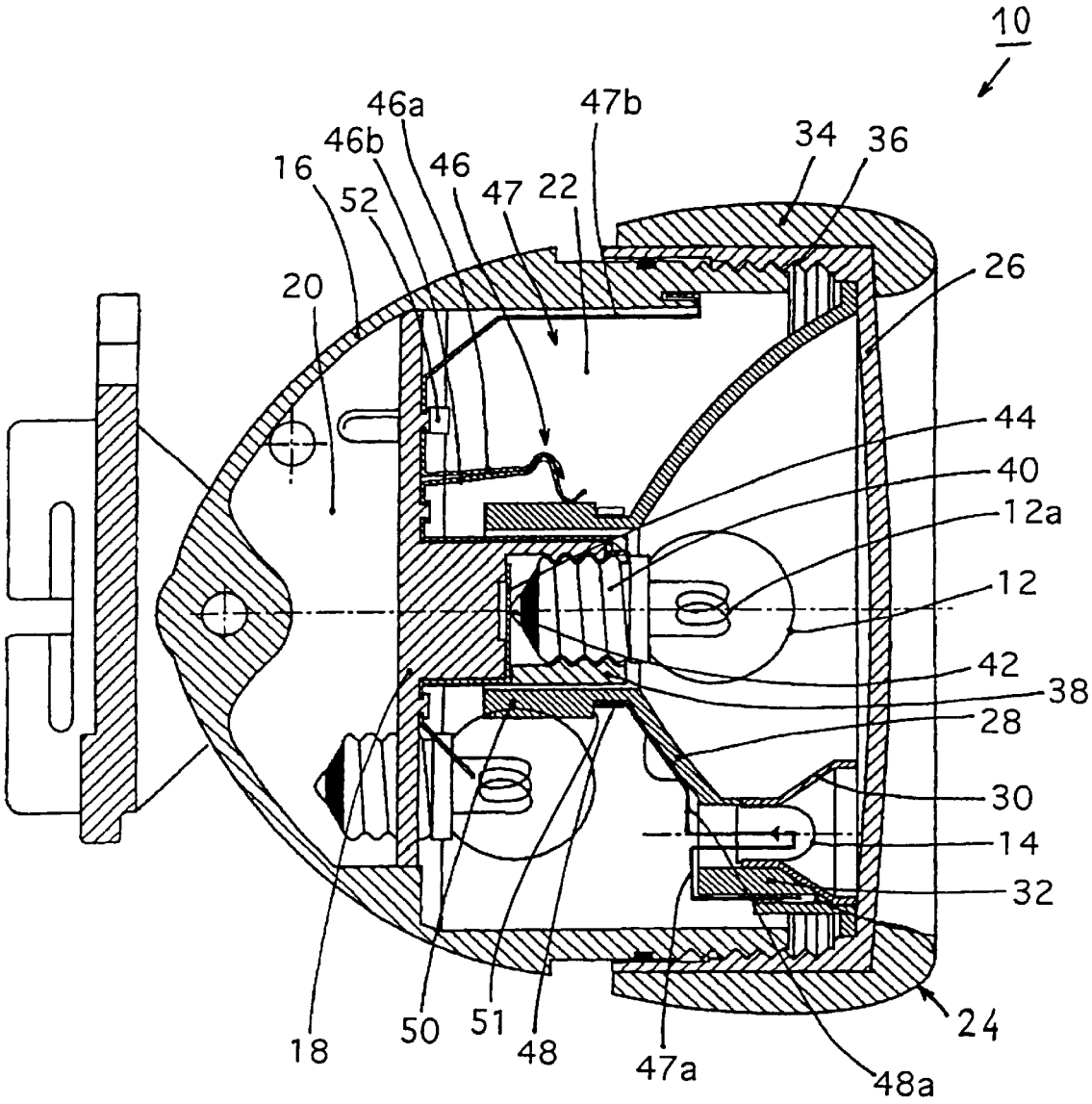

With reference to FIGS. 1 and 2, a portable electric torch 10 with double lighting comprises a housing 16 made of insulating material containing an incandescent bulb 12 and a light-emitting diode LED 14.

The housing 16 is equipped with an intermediate wall 18 in the form of a fixed plate which subdivides the internal volume into a rear compartment 20 for the cable for connection to the power supply case (not represented) to run through, and a front compartment 22 housing the lighting device.

A focussing device 24 comprises a transparent glass plate 26 allowing the light beam originating from the bulb 12 or diode 14 to pass, a parabolic reflector 28 coaxially surrounding the central bulb 12, and an eccentric second reflector 30 surrounding the LED 14, which is housed by engagement in a hollow support 32. The second reflector 30 is smaller than the first reflector 28.

The glass plate 26 which covers the first reflector 28, the second reflector 30 and the LED 14 is joined to a rotary ring 34 screwed onto a threaded end 36 of the housing 16 to actuate the lighting control of the bulb 12 and of the LED 14, and adjustment of the focussing of the light beam. The plate 18 is equipped with a tubular socket 38 acting as housing for the metal base-part 40 of the bulb 12.

The contact terminal 42 of the bulb 12 cooperates in the closed position with a first contact element 44, which is electrically connected to the power supply unit. The lighting circuit comprises a first disconnecting gap 46 formed by a pair of contact parts or blades 46*a,* 46*b,* a second disconnecting gap 47 with contacts 47*a,* 47*b,* and means for connecting the bulb 12 and LED 14 in series. The contact blade 46*b* cooperates with a sliding contact 48 housed in a guide notch 51 of a sleeve 50 and is connected to the metal base 40 of the bulb 12.

During the rotation movement of the ring 34 adjustment of the focussing device 24 and control of the lighting circuit of the bulb 12 and LED 14 is performed by translation of the reflector 28.

In FIG. 1, the LED 14 is lit following closing of the second disconnecting gap 47 and the bulb 12 is not lit on account of the contact blades 46*a,* 46*b* of the first disconnecting gap 46 being in the open state. The sliding contact 47*b* of the second disconnecting gap 47 is connected to one of the poles of the power supply unit via the contact element 52. The other pole is electrically connected to the contact element 48*a* of the LED 14 via the sliding contact 48, the terminal 42, the bulb 12, the filament 12*a,* the metal base-part 40 and the grounding contact 46*b.* The semi-conducting LED 14 conducts in one direction only enabling the bulb 12 to act as connecting conductor for power supply of the LED 14.

In FIG. 2, the LED 14 is unlit following the withdrawal of the grounding contact 46*b* with the sliding contact 48, and opening of the contact 47*b.* The bulb 12 is lit by the contact blades 46*a,* 46*b* of the first disconnecting gap 46 coming into contact. Further actuation of the ring 34 enables adjustment of the focussing device 24 to be performed. The LED 14 and second reflector 30 are moved by the first reflector 28 when rotation of the actuating ring 34 takes place.

The following figures represent different embodiments of lighting torches using the same sequential system for adjustment of the focussing device 24 and control of the lighting circuit of the bulb 12 and LED 14 for different positions of the actuating ring 34. The bulb 12 and LED 14 are electrically connected in parallel. The same reference numbers will be used to designate identical or similar parts.

In FIGS. 3A to 5B, the LED 14 is fixed directly onto the reflector 28, the other reflector 30 of FIGS. 1 and 2 being eliminated. The intermediate wall 18 is fixed, as is the bulb 12, and the sleeve 50, securedly united to the reflector 28, passes through a hole 60 in the intermediate wall 18. The first disconnecting gap 46 comprises a movable contact part 46a operating in conjunction with the end of the sleeve 50 and arranged facing the terminal 42 of the bulb 12. A compression spring 62 is inserted between the bottom of the compartment 20 and the contact part 46*a* urging the latter to the closed position. The second disconnecting gap 47 is composed of a first contact element 47*a* housed in the insulating socket 38 and in permanent contact with the base-part 40 of the bulb 12, and a second contact part 47*b* moving with the sleeve 50.

The movable contact part 46*a* is connected by a flexible wire 64 to one of the poles of the energy source and the first contact element 47*a* is connected to the other pole by a conductor 66. The two terminals of the LED 14 are respectively connected to the second contact part 47*b* by a conductor 67 and by a conductor 70 with a sliding contact 68 connected with the contact part 46*a*. The polarity of the LED 14 will naturally be respected by connecting the anode to the positive pole of the DC power source.

Figure 3B:
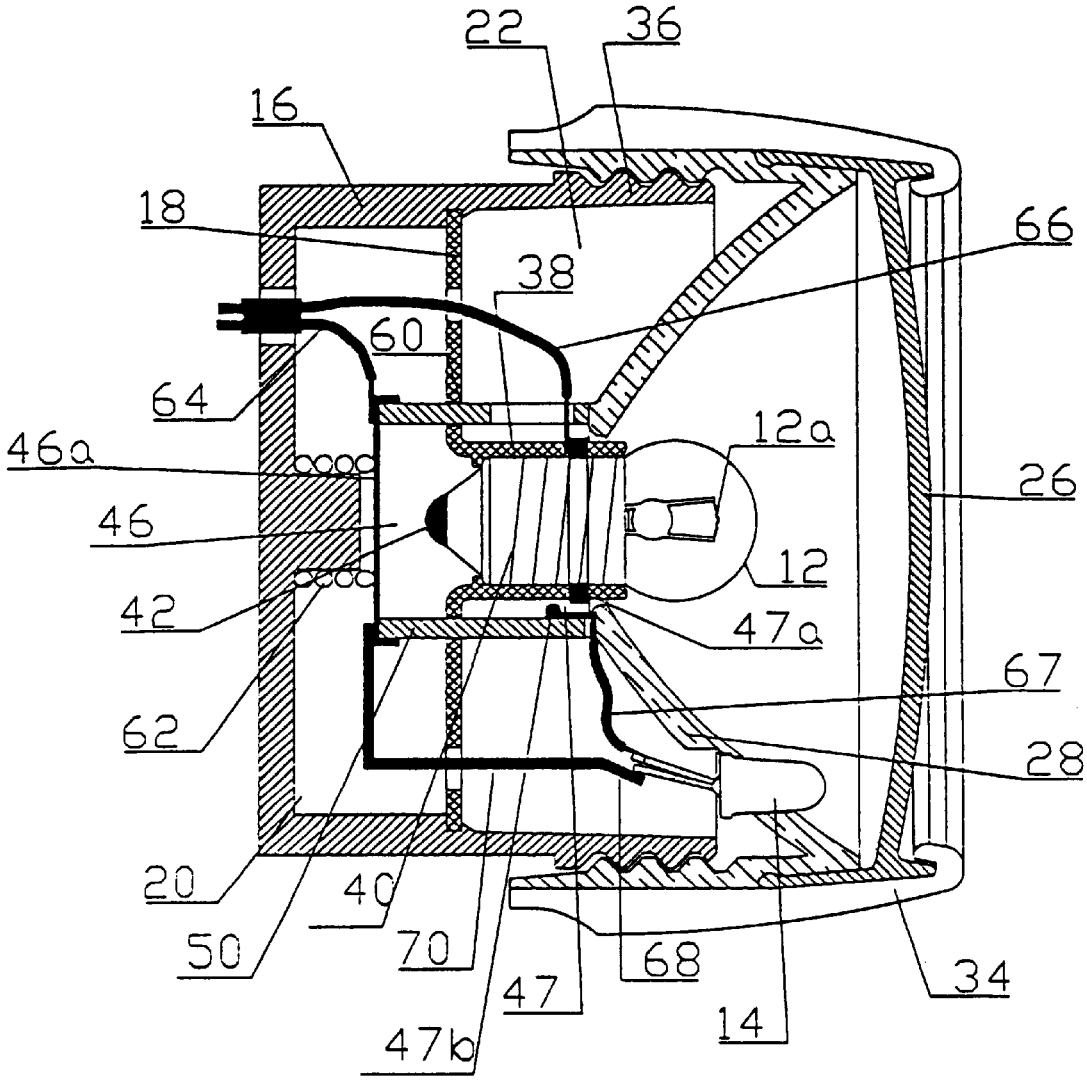
Figure 3A:
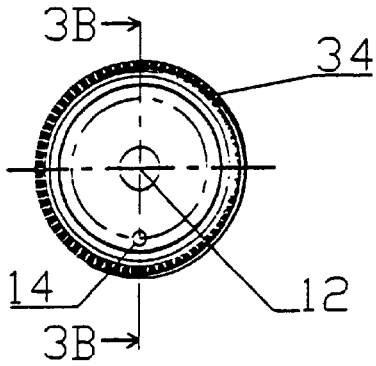

In the rest position illustrated in FIGS. 3 and 3A, the two disconnecting gaps 46 and 47 are open, the bulb 12 and LED 14 being unlit. The ring 34 is fully screwed onto the threaded end 36 of the housing 16, and the distance separating the contact part 46*a* from the terminal 42 of the bulb 12 is maximum. The distance between the open contacts of the first disconnecting gap 46 is greater than that of the second disconnecting gap 47.

Figure 4B:
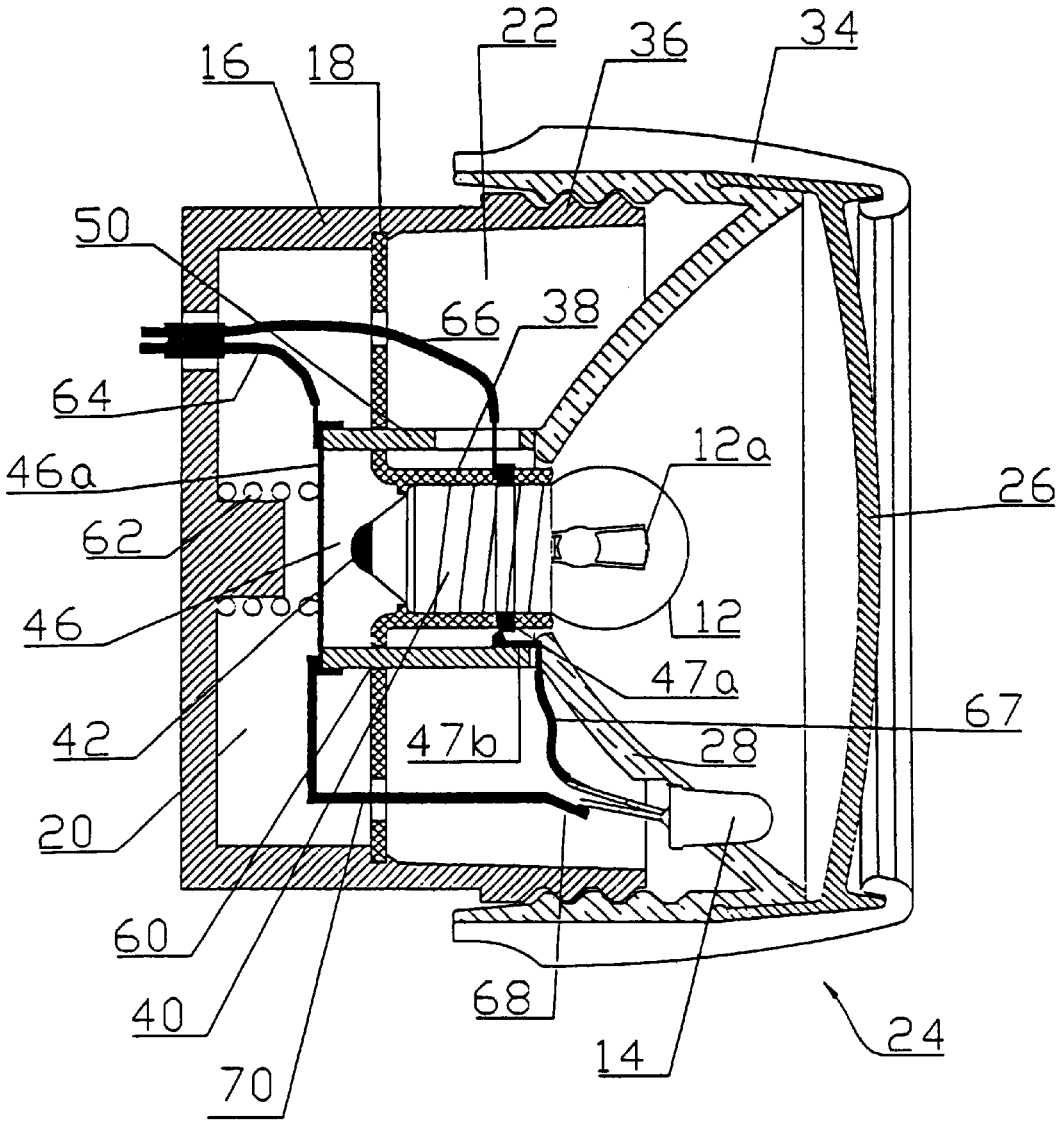
Figure 4A:
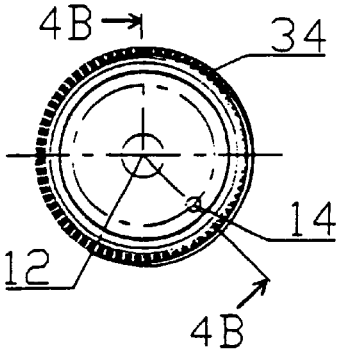

In FIG. 4, rotation of the ring 34 in the unscrewing direction causes a combined rotation and translation movement of the assembly formed by the reflector 28 and sleeve 50. The LED 14 is driven in rotation from position B (FIG. 3A) to position C (FIG. 4A), and the second contact part 47*b* comes into engagement against the first contact part 47*a* causing the LED 14 to be lit. The contact part 46*a* moves towards the terminal, but the bulb 12 remains unlit as a result of opening of the first disconnecting gap 46.

Figure 5B:
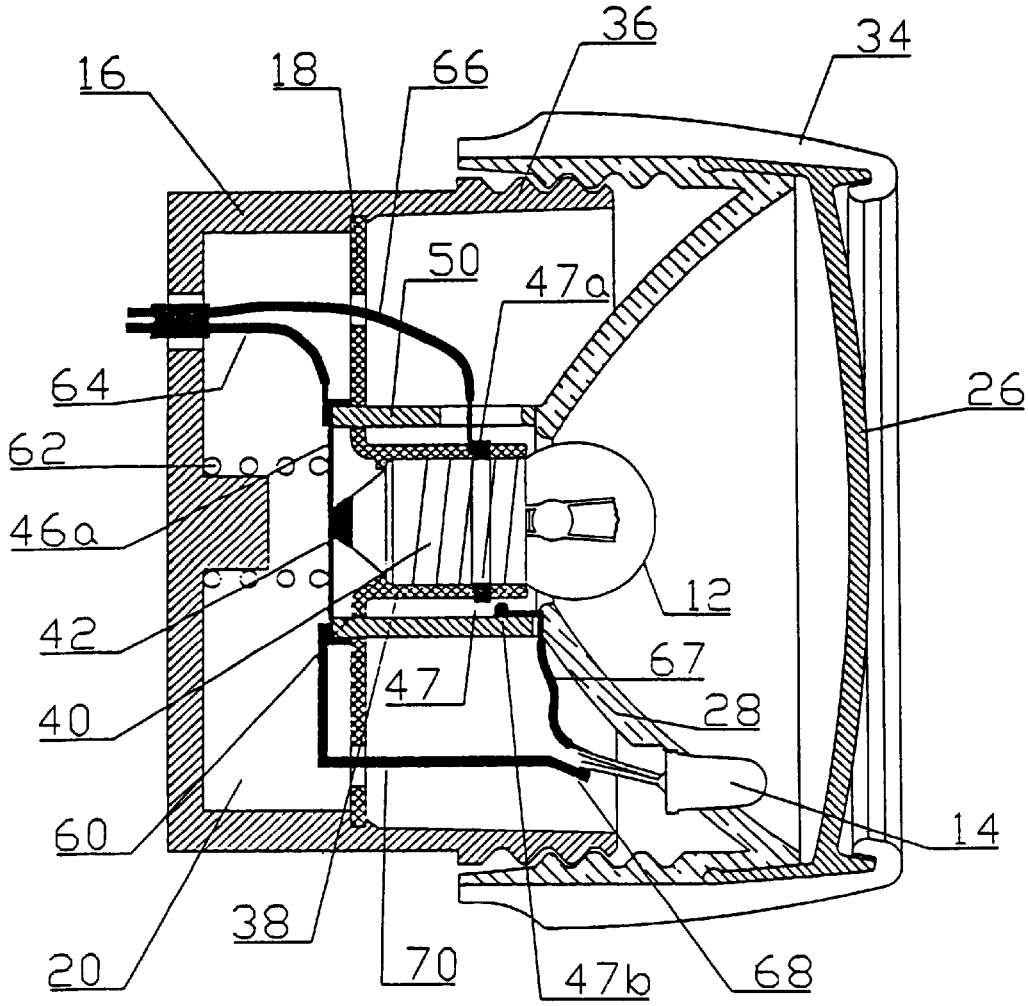
Figure 5A:
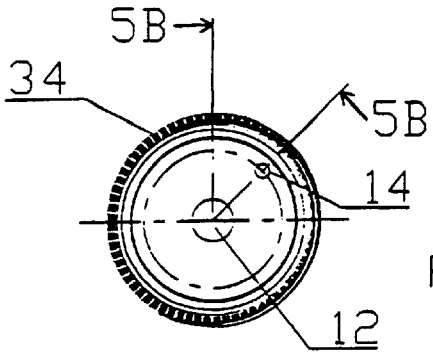
Figure 6B:
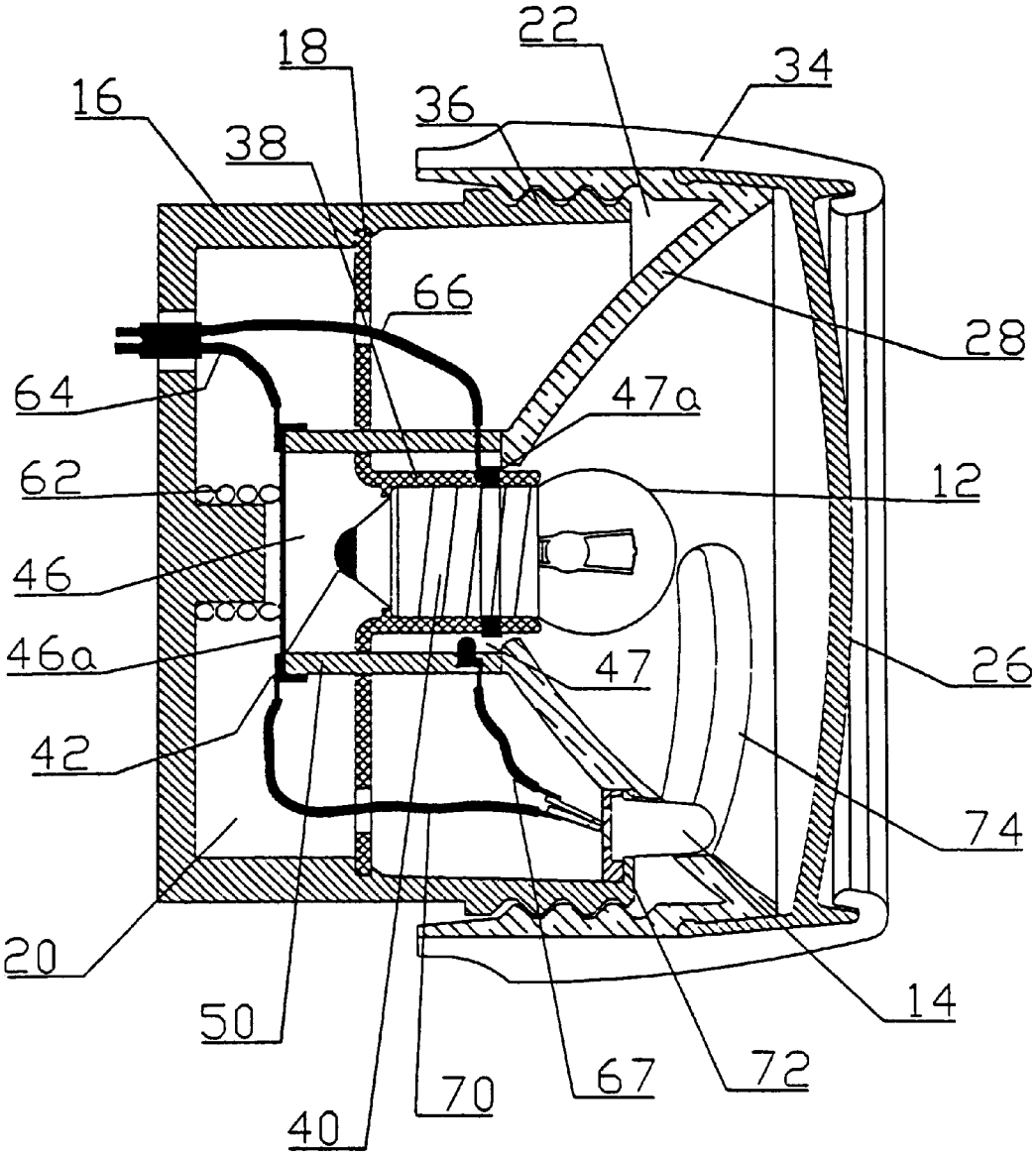
FIGS. 6A to 8B show identical views to those of FIGS. 3A to 5B of another alternative embodiment.
Figure 6A:
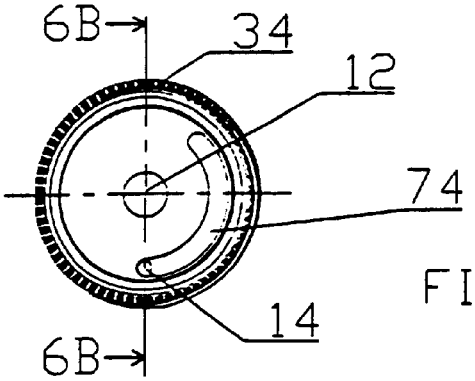
Figure 7B:
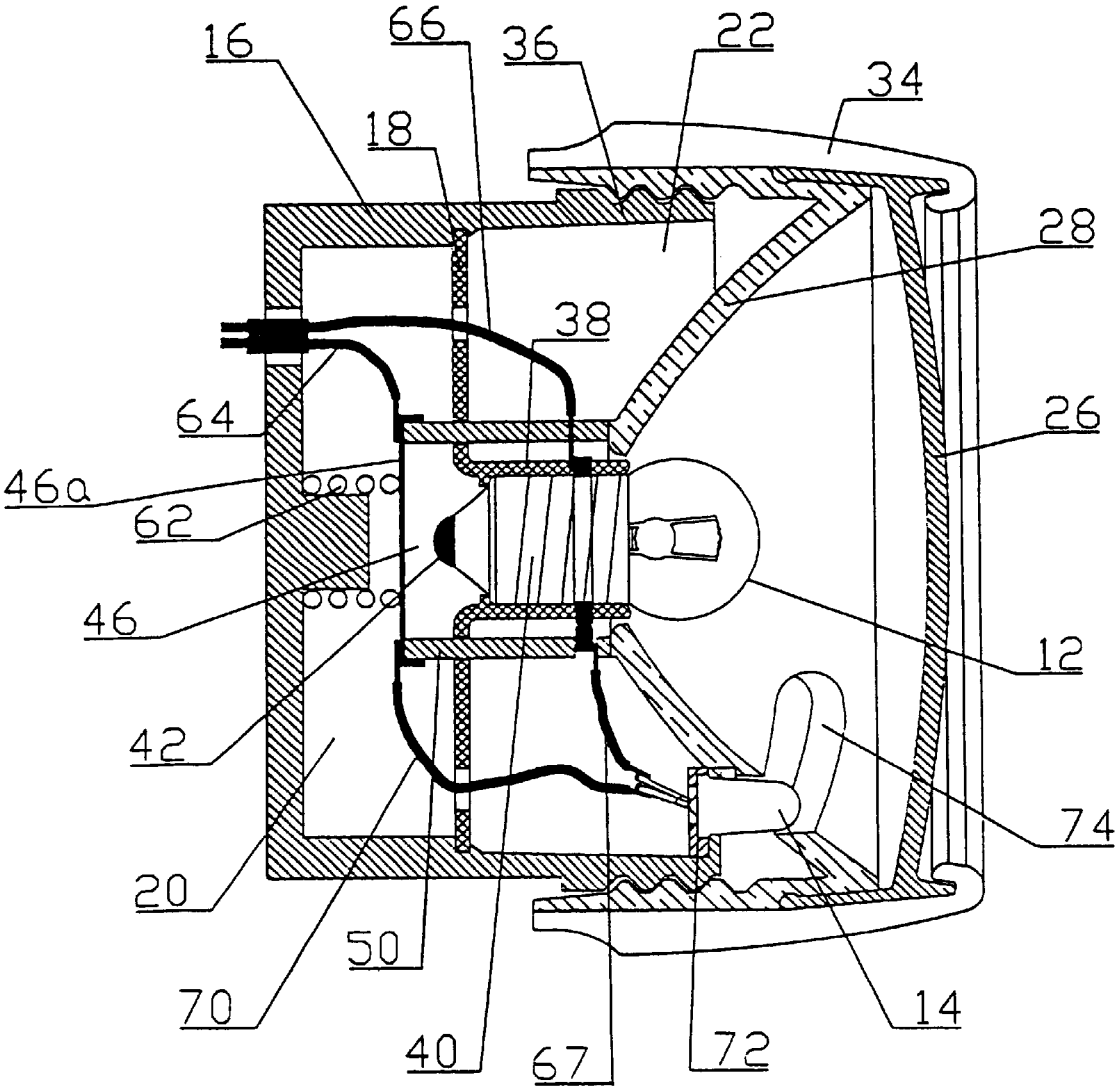
Figure 7A:
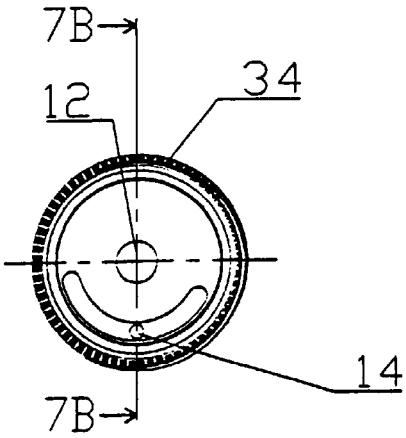
Figure 8B:
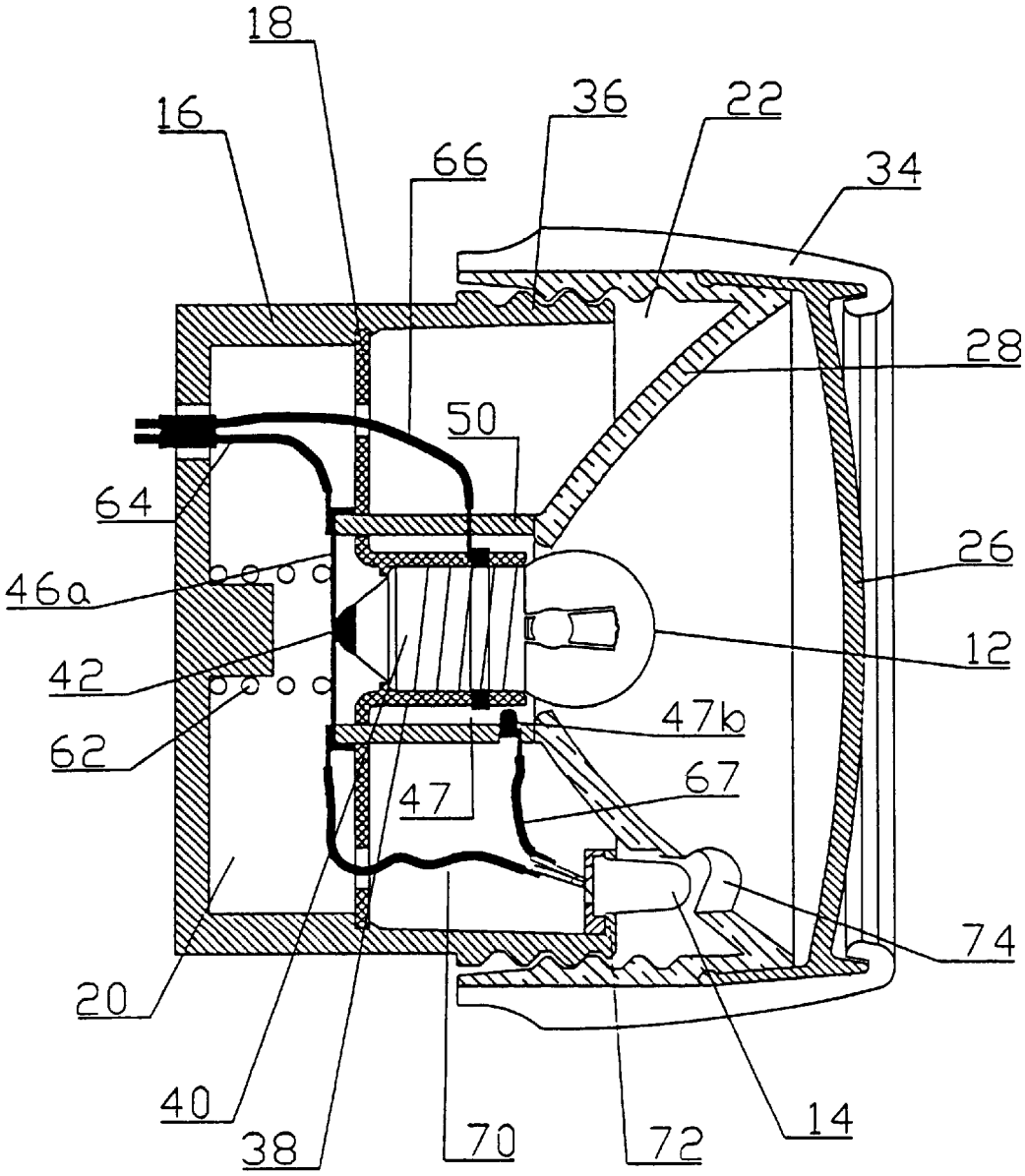
Figure 8A:
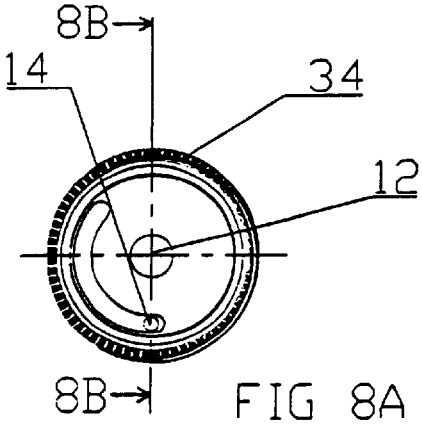

In FIG. 5B, further rotation of the ring 38 in the same direction moves the LED 14 to position D. The second disconnecting gap 47 opens and the LED 14 is switched off. Following withdrawal of the sleeve 50, the spring 62 pushes the contact part 46*a* against the terminal 42 with a preset pressure and allows the bulb 12 to be lit. When unscrewing of the ring 34 is continued from position D to position A (FIG. 5A), the contact part 46a remains immobilized in the closed position and the sleeve 50 moves with the reflector 28 with a relative movement with respect to the fixed bulb 12. Focussing of the light ray emitted by the bulb 12 is then achieved. After the ring 34 has been removed, the bulb 12 remains lit.

Actuating the rotary ring 34 between positions B and A enables the torch to be switched completely off in the rest position, the LED 14 to be switched on and off, the bulb 12 to be switched on, and the focussing to be adjusted.

In the alternative embodiment of FIGS. 6A to 8B, the LED 14 is not securedly united to the mobile reflector 28 and is mounted fixed on a lug 72 of the housing 16. The reflector 28 is provided with a circular groove 74 enabling the LED 14 to pass when rotation of the ring 34 takes place. The sliding contact 68 is eliminated, the conductor 70 being soldered directly onto the contact part 46*a.* Operation of the lighting and adjustment of the focussing is identical to that described previously.

Figure 9:
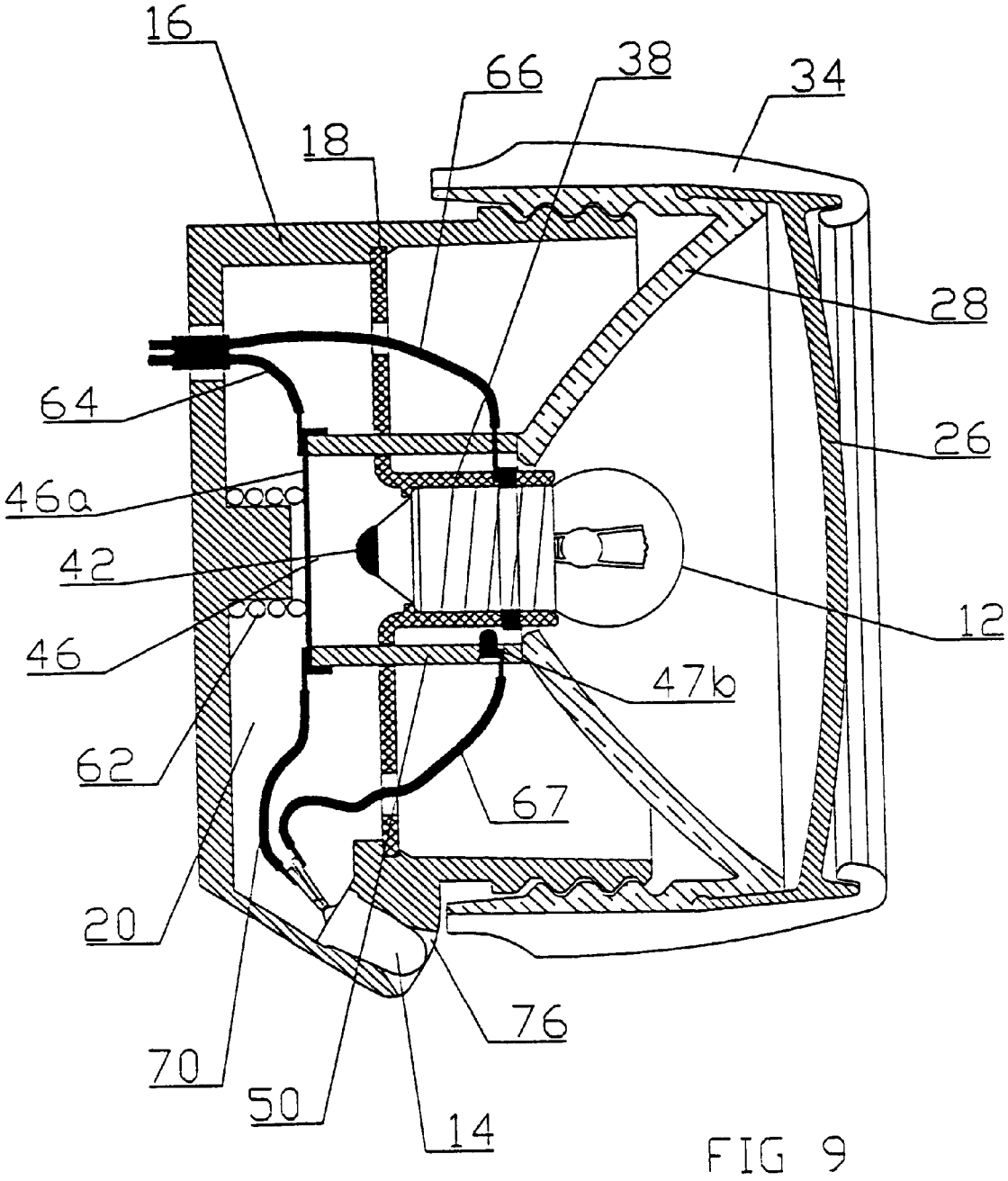
FIGS. 9 to 11 are identical views to those of 3B, 4B and 5B of another alternative embodiment.
Figure 10:
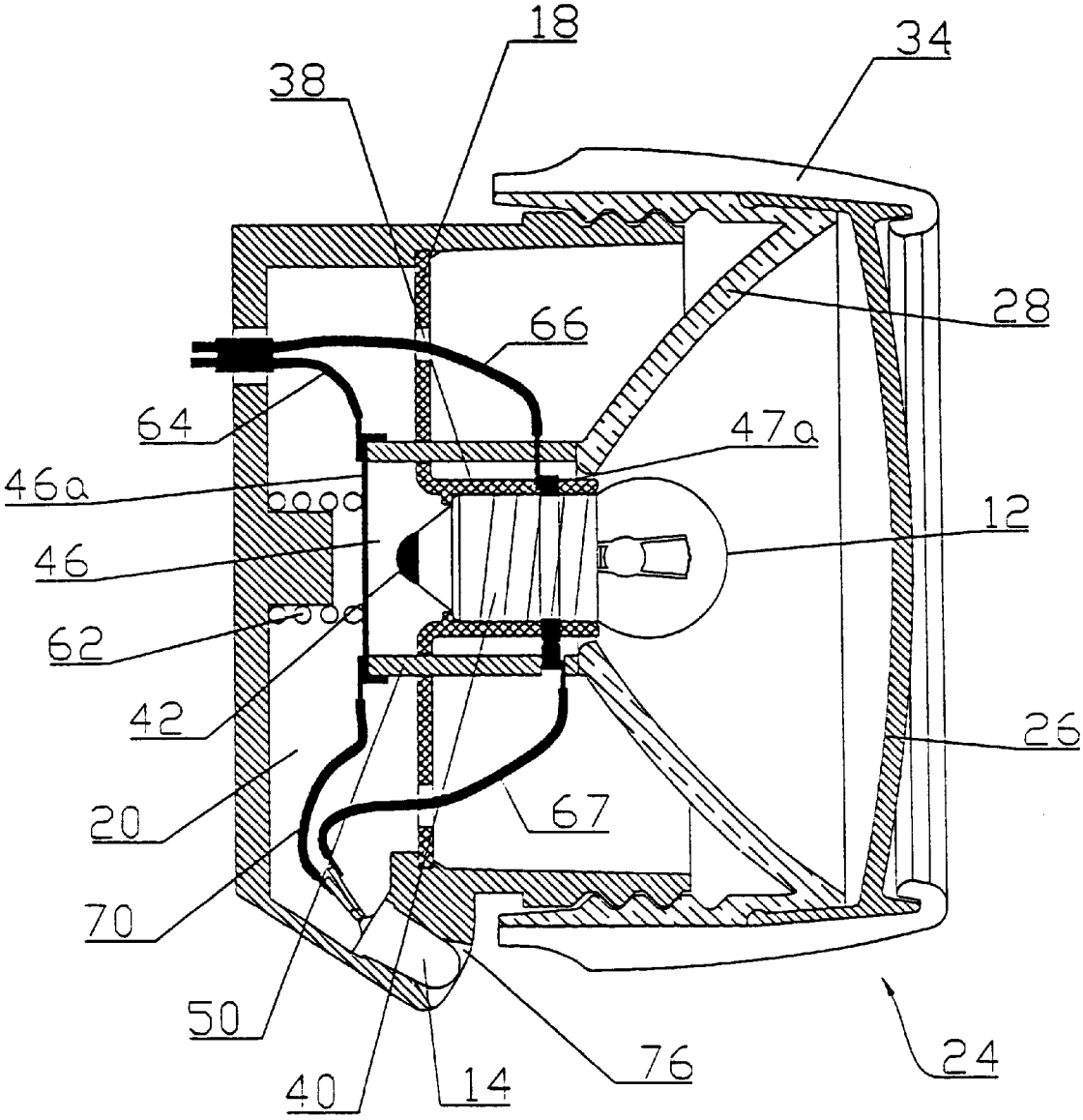
Figure 11:
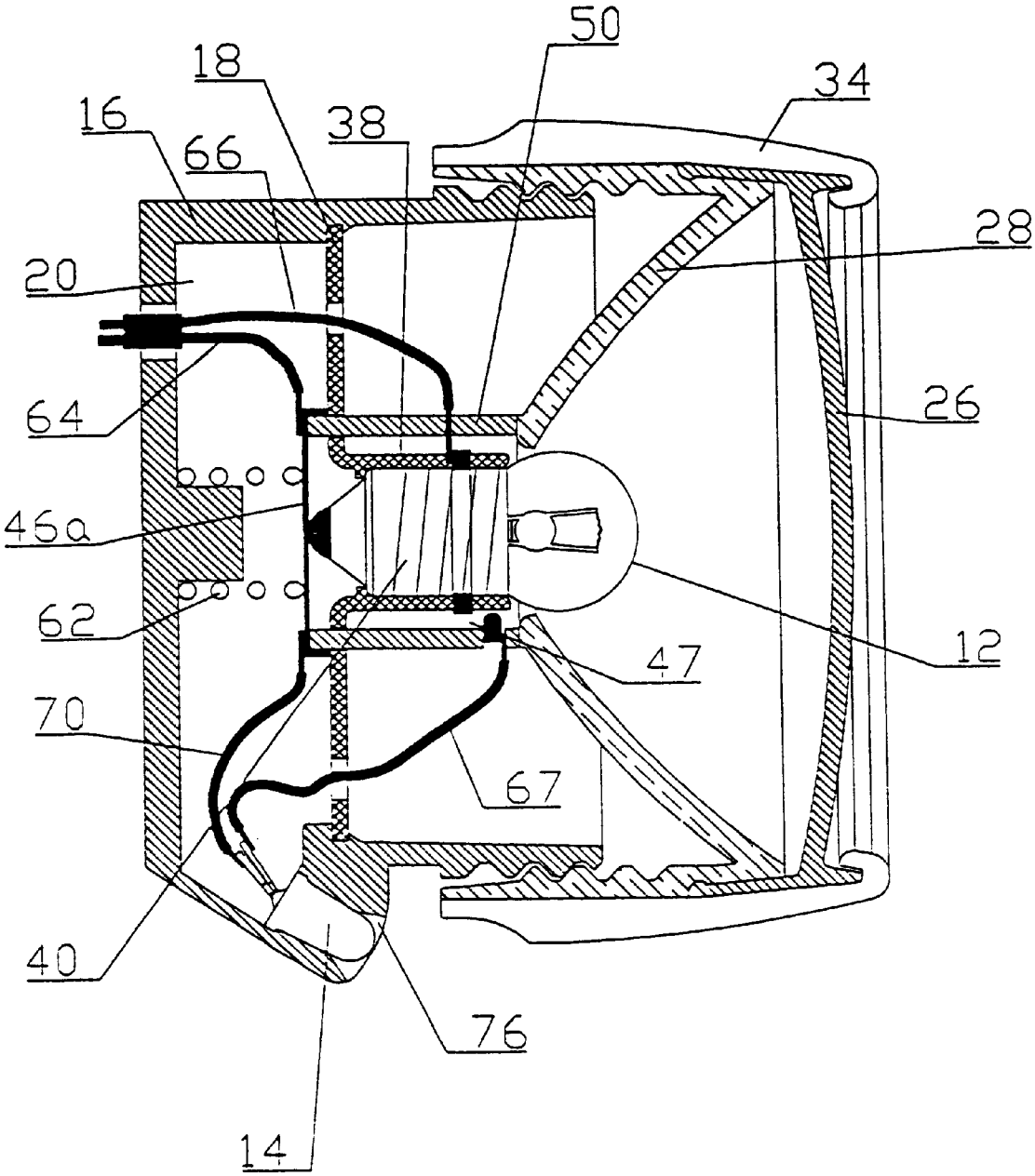

On another alternative embodiment illustrated in FIGS. 9 to 11, the LED 14 is housed outside the reflector 28 in an orifice 76 of the rear compartment 20 of the housing 16. The structure and operation remain identical to those described previously.

Figure 12:
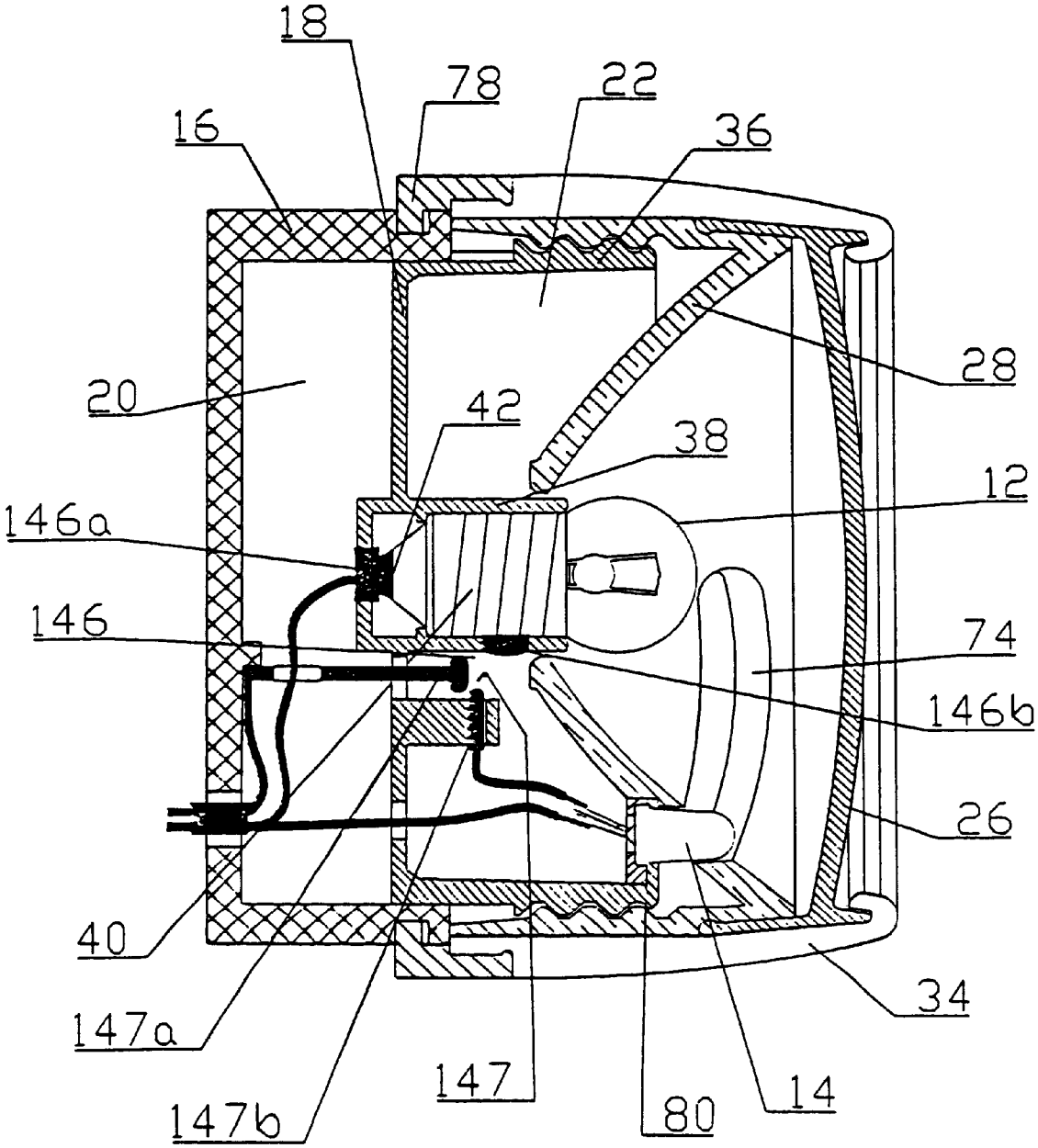
FIGS. 12 to 14 show identical views to those of FIGS. 3B, 4B and 5B of another alternative embodiment.
Figure 13:
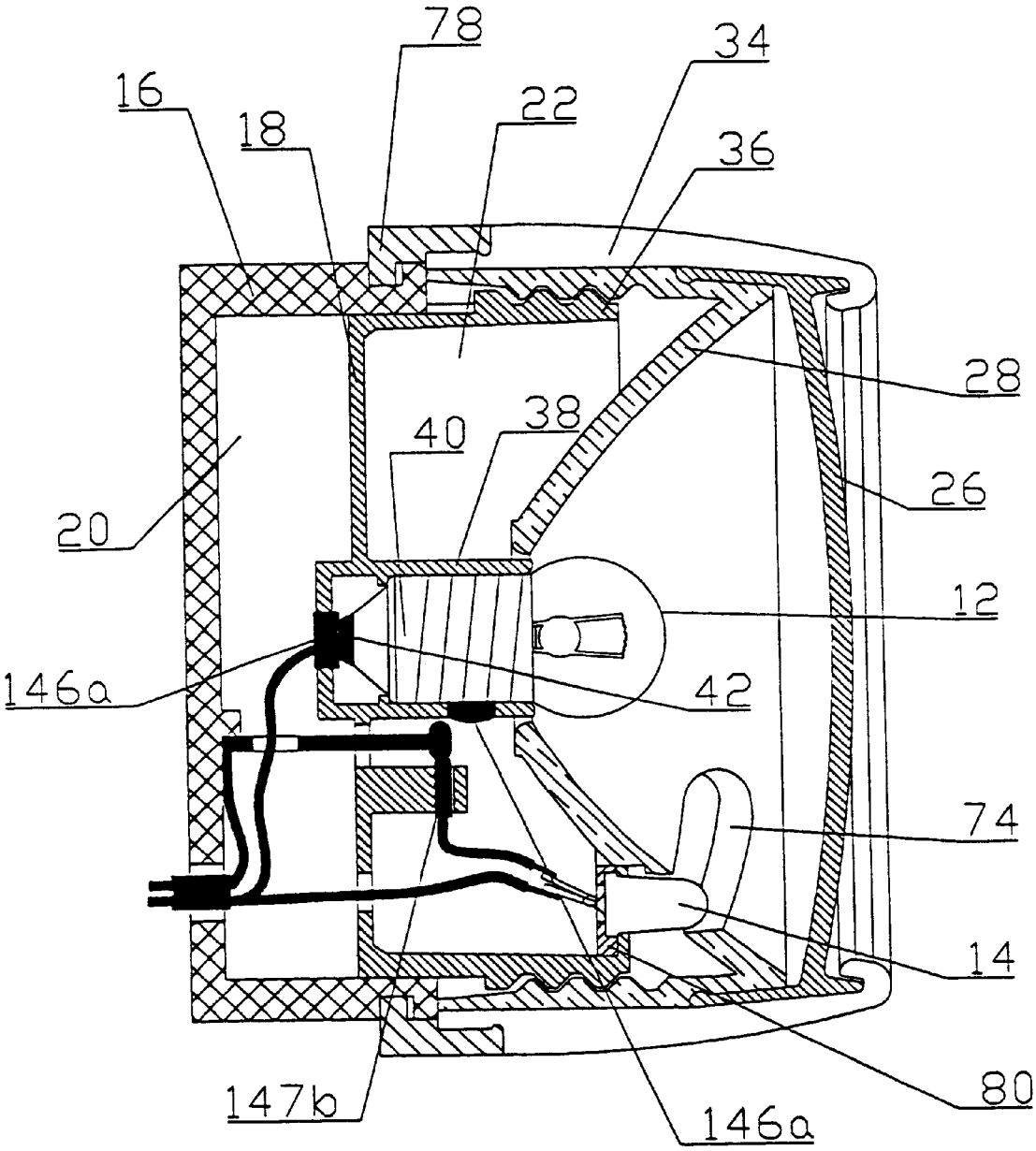
Figure 14:
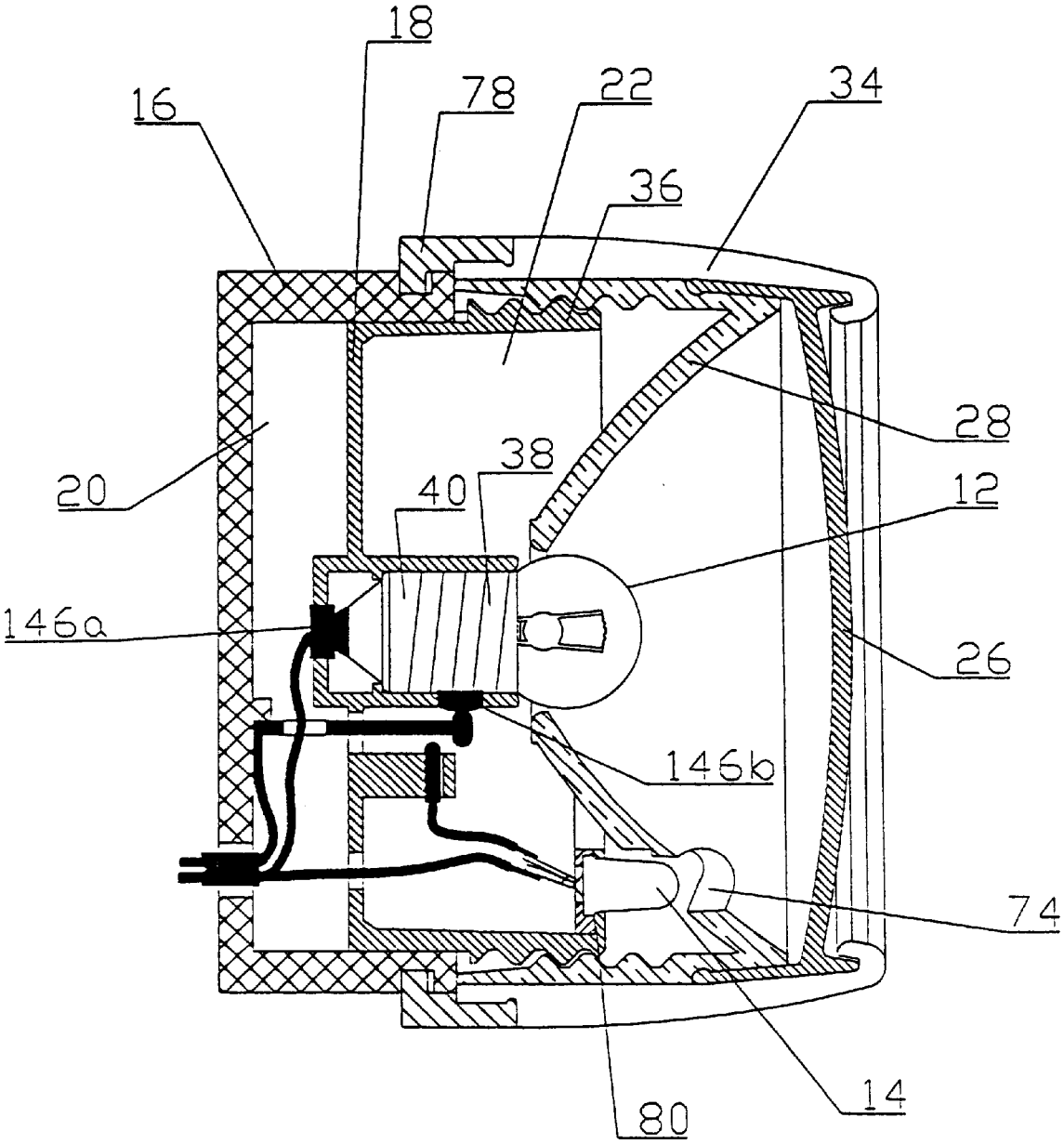

With reference to FIGS. 12 to 14, the reflector 28 and ring 34 can rotate with respect to the housing 16, but are blocked in translation. The threaded end 36 onto which the ring 34 is screwed is in this case securedly united to the intermediate wall 18, whereas the end of the ring 34 is equipped with a spigot 78 engaged in an annular groove of the fixed housing 16. The sleeve 50 is eliminated and the LED 14 is mounted on a lug 80 of the wall 18 facing the circular groove 74 of the reflector 28. The socket 38 is not securedly united to the reflector 28 and moves in translation with the wall 18 when rotation of the ring 34 takes place. The terminal 42 is continuously in contact with a contact part 146*a,* and the two disconnecting gaps 146 and 147 are removed to the level of a three-position switch situated in the front compartment 22.

The three-position switch comprises a contact part 146*a* securedly united to the socket 38, a first stationary contact part 147*a* connected to a pole of the power source, and a second movable contact part 147*b* driven by the movable wall 18.

In the rest position of FIG. 12, the two disconnecting gaps 146 and 147 of the switch are open and the bulb 12 and LED 14 are off. The socket 38 passes through the central orifice of the reflector 28.

When the ring 34 is unscrewed as in FIG. 13, the wall 18 moves backwards moving the bulb 12 and LED 14 with it in translation. The reflector 28 rotates, but without any translation movement. The second contact part 147*b* first comes into contact with the first contact part 147*a* to close the second disconnecting gap 147 to light the LED 14.

In FIG. 14, further rotation of the ring 34 causes the first disconnecting gap 146 to close and opens the second disconnecting gap 147 to light the bulb 12. Extinction of the LED 14 can take place before or after the bulb 12 is lit depending on the distances of the two disconnecting gaps 146 and 147. Further backward movement of the socket 38 which egresses from the orifice of the reflector 28 then enables the focussing of the light beam emitted by the bulb 1 2 to be adjusted.

Figure 15:
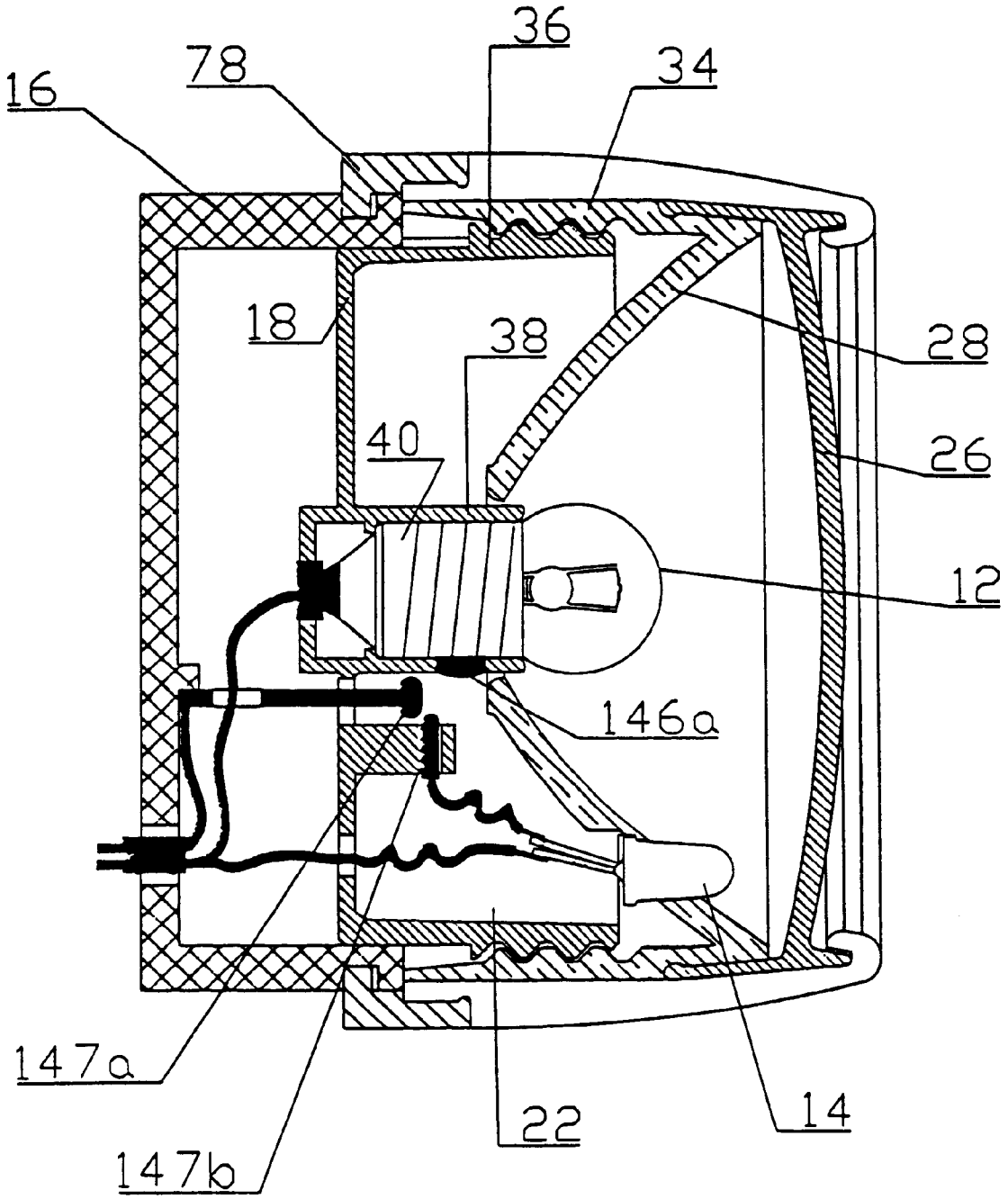
FIGS. 15 to 17 show identical views to those of FIGS. 3B, 4B and 5B of another alternative embodiment.
Figure 16:
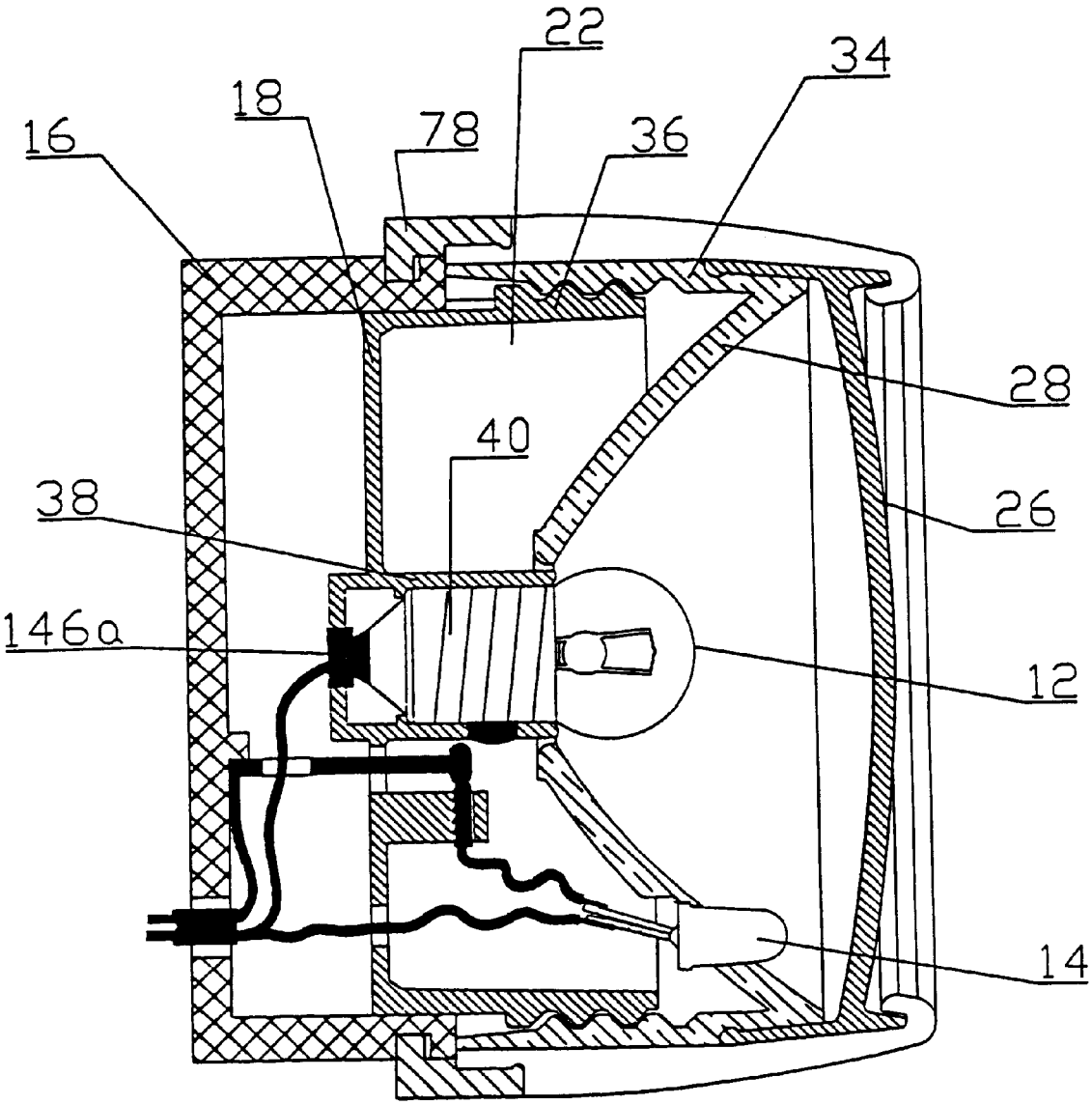
Figure 17:
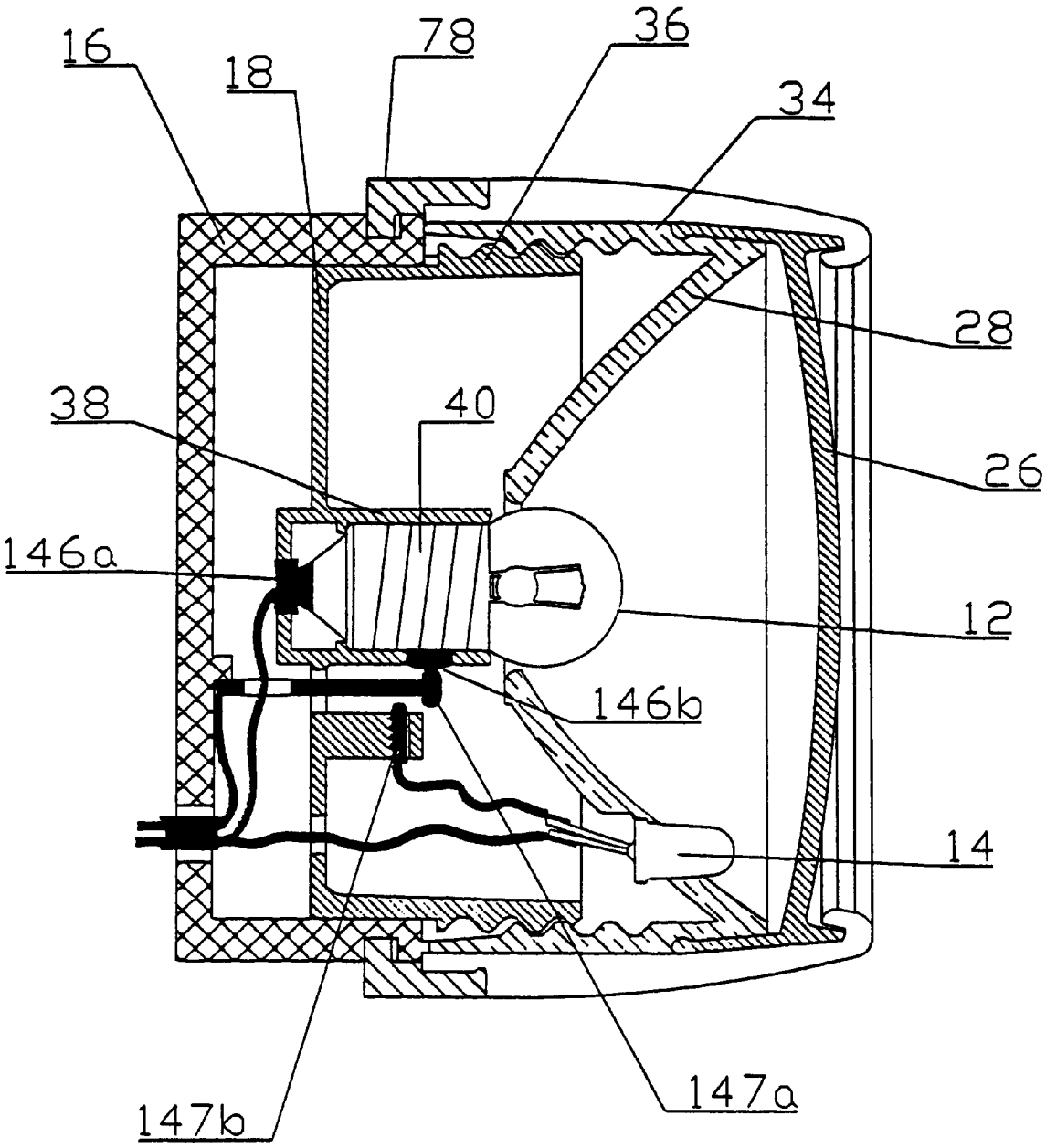

On the alternative embodiment of FIGS. 15 to 17, the same structure of the torch of FIGS. 12 to 14 can be recognized, except for the LED 14 which does not move in translation.

Figure 18:
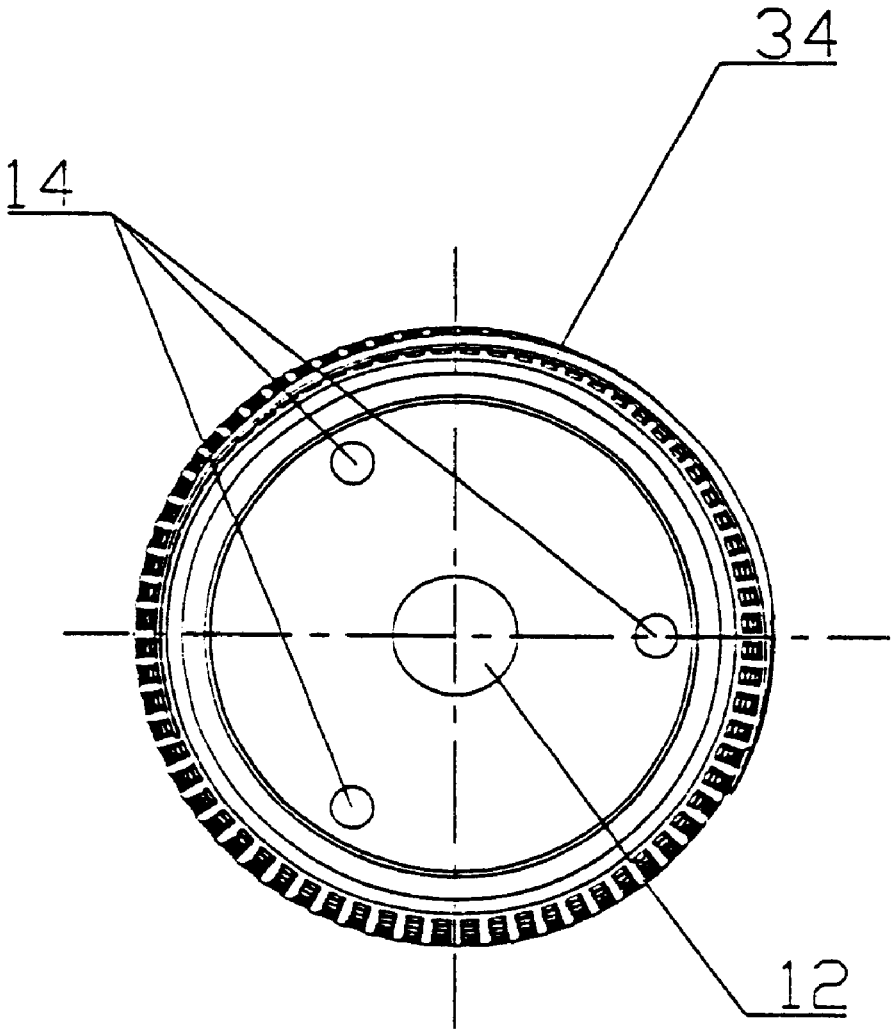
FIG. 18 represents a front view of a torch equipped with a central bulb and a plurality of light-emitting diodes.

FIG. 18 shows a torch equipped with one bulb 12 and three LEDs 14. The LEDs 14 can be lit simultaneously or sequentially depending on whether the lighting circuit comprises one or more disconnecting gaps 147.

What is claimed is:

1. A portable electric torch with double lighting having a housing, comprising:

a first bulb housed in a first reflector for emission of a light beam, said first bulb being in a lighting circuit;

a second bulb connected in said lighting circuit;

actuating means including a rotatable ring for switching said first bulb ON and OFF and for focussing said light beam, said actuating means focussing said light beam by enabling relative movement between said first bulb and said first reflector in translation respectively to a first and second angular position of said rotatable ring;

a first disconnecting gap in said lighting circuit for switching the first bulb ON and OFF, respectively, when said rotatable ring is in said first angular position, and in a rest position; and a second disconnecting gap in said lighting circuit for supplying power to said second bulb when said actuating ring is in a preset third angular position, wherein rotation of said ring enables the torch to be switched completely OFF in the rest position, the second bulb to be switched ON and OFF, and the first bulb to be switched ON while focussing the light beam.

2. The electric torch according to claim 1, wherein the first disconnecting gap is switched to the closed state after closing of the second disconnecting gap takes place to achieve lighting of the second bulb followed by lighting of the first bulb.

3. The electric torch according to claim 1, wherein the first disconnecting gap is switched to the closed state after closing of the second disconnecting gap takes place to achieve lighting of the first bulb followed by lighting of the second bulb.

4. The electric torch according to claim 1, wherein the first bulb is an incandescent or halogen bulb for lighting at a distance and the second bulb is formed by a LED for close-up lighting, the two bulbs being connected in parallel.

5. The electric torch according to claim 1, wherein the second bulb is securedly united to the first reflector, the first reflector being fixed to the rotatable ring, the second bulb being eccentric with respect to the first bulb.

6. The electric torch according to claim 1, wherein the first reflector has a semi-circular groove, the second bulb is mounted on a lug of the housing and facing the semi-circular groove, said groove allowing relative movement between said reflector and the second bulb.

7. The electric torch according to claim 1, wherein the second bulb is located outside the first reflector and is housed in an orifice of the housing.

8. The electric torch according to one of the claim 5, wherein the first reflector has a sleeve movable in translation and in rotation with the rotatable ring, said sleeve being used for opening and closing of the first and second disconnecting gaps and wherein the first bulb is accommodated in a fixed socket.

9. The electric torch according to claim 8, further comprising an intermediate wall, wherein the first reflector is securely united to the rotatable ring, the rotatable ring being blocked in translation when its internal threading cooperates with the conjugate threading of the intermediate wall, said fixed socket accommodates a metal base of the first bulb and is supported by said intermediate wall, the support socket being movable in translation for the switching of the first and second disconnecting gaps and for adjustment of the focussing.

10. The electric torch according to claim 1, further comprising a plurality of secondary bulbs with simultaneous or sequential lighting.

11. The electric torch according to claim 10, wherein the secondary bulbs are light-emitting diodes.

12. The electric torch according to claim 1, wherein the second bulb is surrounded by a second reflector smaller than the first reflector.

* * * * *